US008261836B2

(12) United States Patent
Noske et al.

(10) Patent No.: US 8,261,836 B2
(45) Date of Patent: Sep. 11, 2012

(54) DOWNHOLE DEPLOYMENT VALVES

(75) Inventors: Joe Noske, Houston, TX (US); David Iblings, Houston, TX (US); David Pavel, Kingwood, TX (US); David J. Brunnert, Cypress, TX (US); Paul Smith, Katy, TX (US); Michael Brian Grayson, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 813 days.

(21) Appl. No.: 12/098,264

(22) Filed: Apr. 4, 2008

(65) Prior Publication Data

US 2008/0245531 A1 Oct. 9, 2008

Related U.S. Application Data

(60) Provisional application No. 60/910,129, filed on Apr. 4, 2007.

(51) Int. Cl.
*E21B 34/06* (2006.01)
*E21B 34/12* (2006.01)

(52) U.S. Cl. ..... 166/332.8; 166/373; 137/527

(58) Field of Classification Search ..... 166/332.1, 166/332.8, 325, 373; 137/515, 521, 527
See application file for complete search history.

(56) References Cited

U.S. PATENT DOCUMENTS

| | | | | |
|---|---|---|---|---|
| 4,161,985 | A * | 7/1979 | Fournier et al. | 166/321 |
| 4,294,314 | A | 10/1981 | Miyagishima et al. | |
| 4,624,315 | A | 11/1986 | Dickson et al. | |
| 4,846,281 | A | 7/1989 | Clary et al. | |
| 5,137,090 | A | 8/1992 | Hare et al. | |
| 6,209,663 | B1 | 4/2001 | Hosie | |
| 6,227,299 | B1 | 5/2001 | Dennistoun | |
| 7,537,062 | B2 * | 5/2009 | Hughes et al. | 166/386 |
| 2002/0070028 | A1 | 6/2002 | Garcia et al. | |
| 2005/0039922 | A1 | 2/2005 | Vick, Jr. et al. | |
| 2010/0294502 | A1 * | 11/2010 | Xu | 166/332.8 |

FOREIGN PATENT DOCUMENTS

| | | |
|---|---|---|
| EP | 0915230 | 5/1999 |
| GB | 240516 | 10/1925 |
| GB | 2297572 | 8/1996 |
| GB | 2405165 | 2/2005 |

OTHER PUBLICATIONS

Canadian Office Action for Application No. 2,627,638 dated Jul. 30, 2010.
Canadian Office Action for Application No. 2,627,838 dated Sep. 17, 2009.
EP Search Report for Application No. 08153771.4-2315/1980711 dated Mar. 30, 2010.
EP Office Action for Application No. 08 153 771.4-2315 dated Jun. 8, 2011.

* cited by examiner

*Primary Examiner* — Daniel P Stephenson
(74) *Attorney, Agent, or Firm* — Patterson & Sheridan, L.L.P.

(57) ABSTRACT

Methods and apparatus enable reliable and improved isolation between two portions of a bore extending through a casing string disposed in a borehole. A downhole deployment valve (DDV) may provide the isolation utilizing a valve member such as a flapper that is disposed in a housing of the DDV and is designed to close against a seat within the housing. The DDV includes an operating mechanism for opening/closing the DDV. In use, pressure in one portion of a well that is in fluid communication with a well surface may be bled off and open at well surface while maintaining pressure in another portion of the casing string beyond the DDV.

21 Claims, 16 Drawing Sheets

DOWNHOLE DEPLOYMENT VALVES

CROSS-REFERENCE TO RELATED APPLICATIONS

This application claims benefit of U.S. provisional patent application Ser. No. 60/910,129, filed Apr. 4, 2007, which is herein incorporated by reference.

BACKGROUND OF THE INVENTION

1. Field of the Invention

Embodiments of the invention generally relate to methods and apparatus for use in oil and gas wellbores. More particularly, the invention relates to methods and apparatus for utilizing deployment valves in wellbores.

2. Description of the Related Art

Forming an oil/gas well begins by drilling a borehole in the earth to some predetermined depth adjacent a hydrocarbon bearing formation. After the borehole is drilled to a certain depth, steel tubing or casing inserted in the borehole forms a wellbore having an annular area between the tubing and the earth that is filled with cement. The tubing strengthens the borehole while the cement helps to isolate areas of the wellbore during hydrocarbon production.

A well drilled in a "overbalanced" condition with the wellbore filled with fluid or mud thereby precludes the inflow of hydrocarbons until the well is completed and provides a safe way to operate since the overbalanced condition prevents blow outs and keeps the well controlled. Disadvantages of operating in the overbalanced condition include expense of the mud and damage to formations if the column of mud leaks off into the formations. Therefore, employing underbalanced or near underbalanced drilling may avoid problems of overbalanced drilling and encourage the inflow of hydrocarbons into the wellbore. In underbalanced drilling, any wellbore fluid such as nitrogen gas is at a pressure lower than the natural pressure of formation fluids. Since underbalanced well conditions can cause a blow out, underbalanced wells must be drilled through some type of pressure device such as a rotating drilling head at the surface of the well. The drilling head permits a tubular drill string to be rotated and lowered therethrough while retaining a pressure seal around the drill string.

A downhole deployment valve (DDV) located as part of the casing string and operated through a control line enables temporarily isolating a formation pressure below the DDV such that a tool string may be quickly and safely tripped into a portion of the wellbore above the DDV that is temporarily relieved to atmospheric pressure. An example of a DDV is described in U.S. Pat. No. 6,209,663, which is incorporated by reference herein in its entirety. Thus, the DDV allows the tool string to be tripped into and out of the wellbore at a faster rate than snubbing the tool string in under pressure. Since the pressure above the DDV is relieved, the tool string can trip into the wellbore without wellbore pressure acting to push the tool string out. Further, the DDV permits insertion of a tool string into the wellbore that cannot otherwise be inserted due to the shape, diameter and/or length of the tool string. However, prior designs for the DDV can suffer from any of various disadvantages such as sealing problems at a valve seat, sticking open of a valve member, inadequate force maintaining the valve member closed, high manufacturing costs, long non-modular arrangements, difficulties associated with coupling of control lines to the DDV, and housings with low pressure ratings Therefore, there exists a need for an improved DDV assembly and associated methods.

SUMMARY OF THE INVENTION

The invention generally relates to methods and apparatus that enable reliable and improved isolation between two portions of a bore extending through a casing string disposed in a borehole. A downhole deployment valve (DDV) may provide the isolation utilizing a valve member such as a flapper that is disposed in a housing of the DDV and is designed to close against a seat within the housing. The DDV includes an operating mechanism for opening/closing the DDV. In use, pressure in one portion of a well that is in fluid communication with a well surface may be bled off and open at well surface while maintaining pressure in another portion of the casing string beyond the DDV.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to isolating an interior first section of a casing string from an interior second section of the casing string. The casing string may include a downhole deployment valve (DDV) that has an outer housing. In any of the embodiments described herein, the housing may form an intermediate portion of the casing string with cement disposed in an annular area between a borehole wall and an exterior surface of the casing string including an outside of the housing, depending on level of the cement in the annular area, to secure the casing string in the borehole. Further, the DDV may in any embodiment couple with a tie-back end, such as a polished bore receptacle, of a casing or liner that integrates with the DDV to form the casing string. A valve member such as a flapper valve within the DDV enables sealing between the first and second sections of the casing string such that pressure in the first section that is in fluid communication with a well surface may be bled off and open at the well surface while maintaining pressure in the second section of the casing string.

Figure 1:
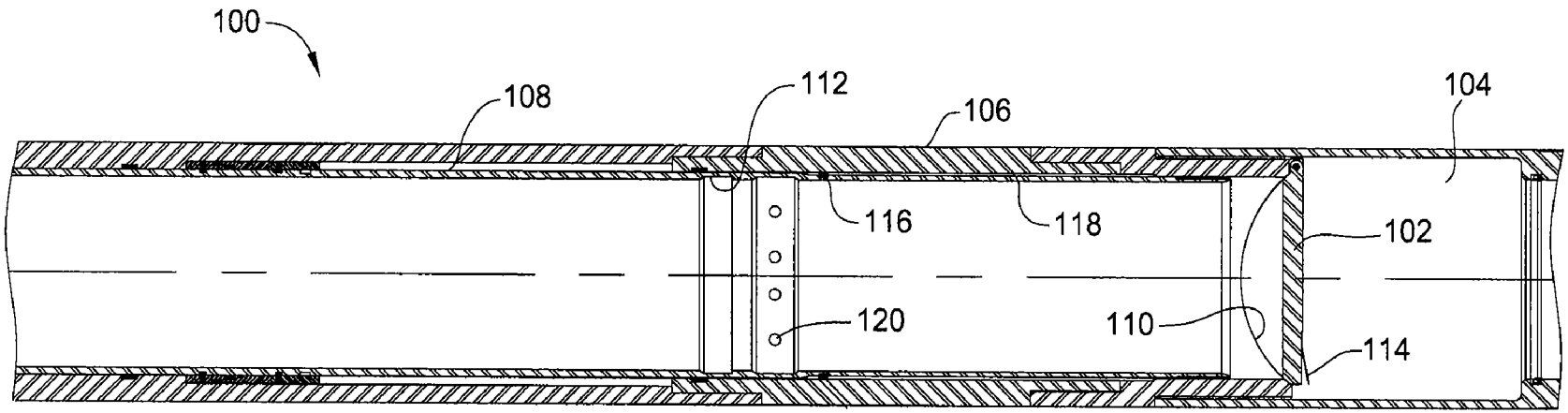
FIG. 1 is a cross section view of a downhole deployment valve (DDV) in a closed position, according to one embodiment of the invention.

FIG. 1 shows a cross section view of a DDV 100 in a closed position due to a flapper 102 obstructing a longitudinal central bore 104 through the DDV 100. The DDV 100 further includes an outer housing 106 with an actuation sleeve 108 disposed concentrically within the housing 106. The actuation sleeve 108 represents an exemplary mechanism for moving the flapper 102 to open the DDV 100 although other types of actuators may be used in some embodiments. In operation, the sleeve 108 slides within the housing 106 based on control signals received to selectively displace the flapper 102 due to movement of the sleeve 108 across an interface between the flapper 102 and a seat 110. Biasing of the flapper 102 may return the flapper 102 into contact with the seat 110 upon withdrawal of the sleeve 108.

Figure 3:
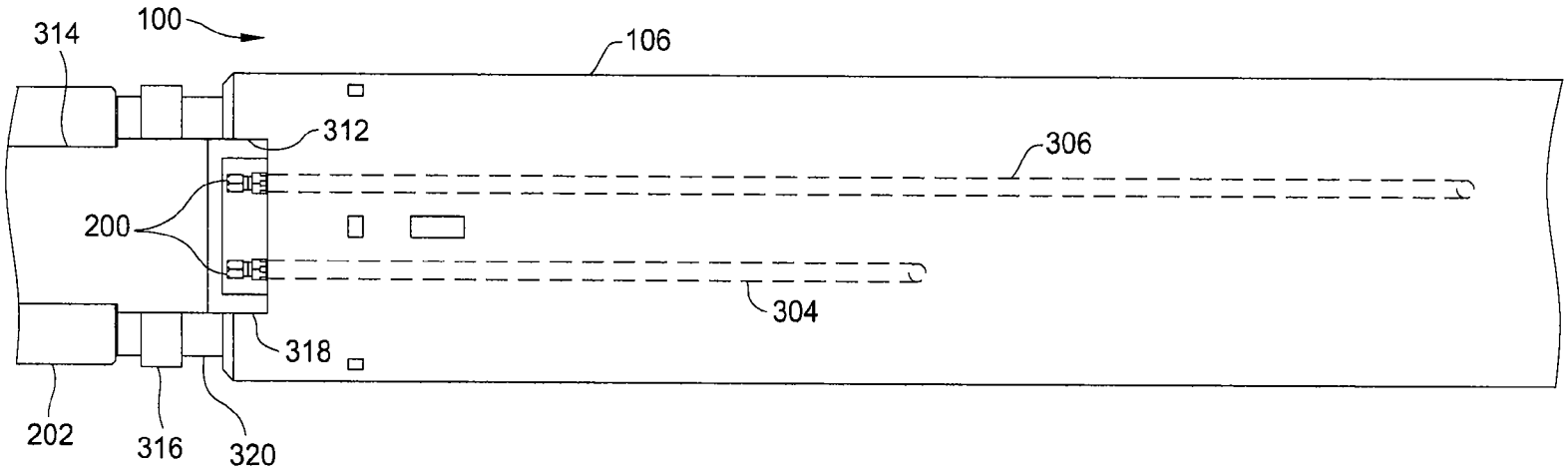
FIGS. 2 and 3 are respectively cross section and side views of a control line connection at a first end of the DDV.
Figure 2:
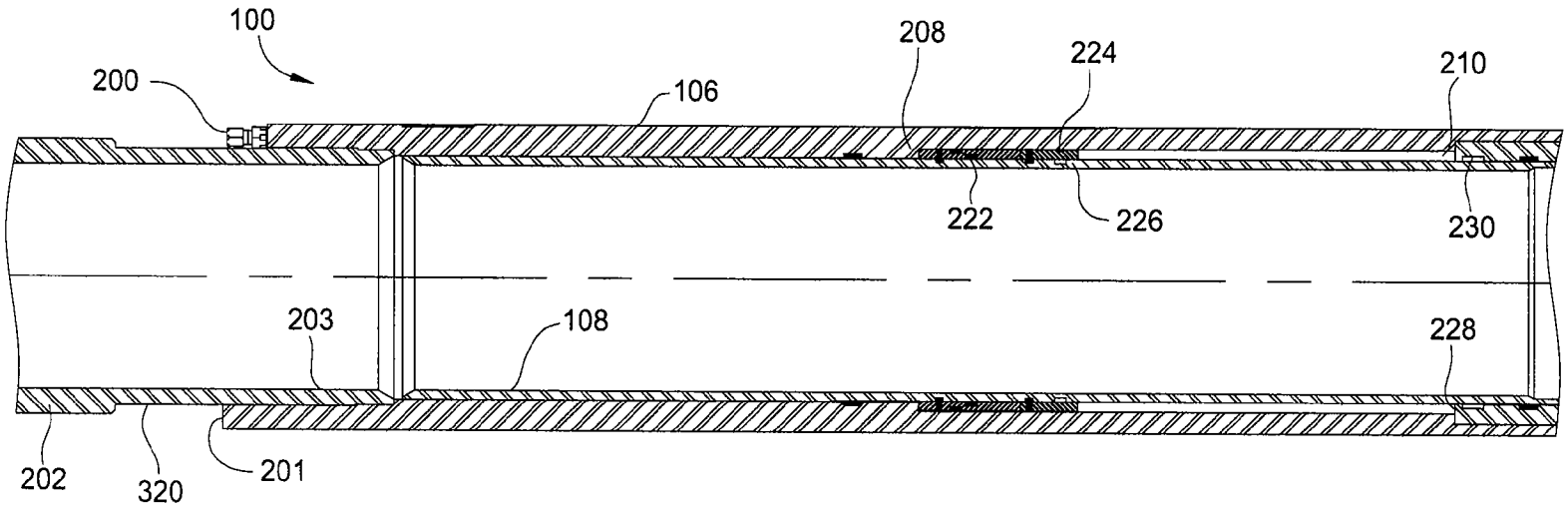

FIGS. 2 and 3 illustrate control line connections 200 at a first end 201 of the housing 106 where the DDV 100 couples to a first casing length 202 that extends to the well surface. The connections 200 extend in a direction parallel with the longitudinal axis of the DDV 100 and are outlets for first and second bores 304, 306 through the housing 106. The bores 304, 306 provide fluid passage respectively to first and second piston chambers 208, 210 defined between the housing 106 and the sleeve 108. Fluid pressure supplied to the first piston chamber 208 moves the sleeve 108 in a first direction to open the DDV 100. To return to the closed position, fluid pressure introduced into the second piston chamber 210 acts on the sleeve 108 in an opposite second direction to slide the sleeve 108 out of interference with the flapper 102.

The control line connections 200 extend from the housing 106 at a longitudinal slot or recess 312 in an outer diameter of the housing 106. Since the connections 200 are at the first end 201 of the housing 106, a pin end 203 of the first casing length 202 extends into the first end 201 beyond the connections 200 for coupling the DDV 100 to the first casing length 202. Compared to control line attachment options that require removal of material from DDV housing portions that may be under pressure in use, this arrangement for the connections 200 in combination with a control line protector 314 guards the connections 200 and control lines coupled to the connections 200 from harmful effects such as abrasion and axial tension without detrimentally effecting pressure ratings of the DDV 100.

FIG. 3 shows the control line protector 314 having a band clamp 316 and a protrusion 318 extending into the recess 312 in the housing 106. The control line protector 314 covers and retains the control lines attached to the control line connections 200. Examples of the protector 314 include any conventional cable protector such as may be utilized along the casing string between each joint. The protrusion 318 of the protector rotationally keys the protector 314 relative to the housing 106 to prevent control line disengagement at the control line connections 200 due to potential rotation of the protector 314. The band clamp 316 secures around a recess 320 in an outer diameter of the first casing length 202 adjacent to the first end 201 of the housing 106 in order to further affix the protector 314 relative to the connections 200.

Referring back to FIG. 1, inner mating profiles 112 in the sleeve 108 enable engagement of the sleeve 108 with a corresponding profile tool for manipulating the location of the sleeve 108 by mechanical force. This mechanical manipulation may occur only after freeing the sleeve 108 from any possible hydraulic lock in the first or second chambers 208, 210 as visible in FIG. 2. A releasable sealing ring 222 shear pins to an outside of the sleeve 108 to permit free movement of the sleeve 108 relative to the sealing ring 222 upon overcoming an identified force required to break attachment between the sealing ring 222 and the sleeve 108. The sealing ring 222 spans an annular area between the housing 106 and the sleeve 108 to define and isolate the first and second chambers 208, 210 from one another.

A releasable retaining ring 224 also couples, by a shear pinned connection, to the outside of the sleeve 108 adjacent the sealing ring 222 within the second chamber 210. The retaining ring 224 surrounds a locking or expansion ring, such as a biased C-ring 226, disposed around the sleeve 108 and maintains the C-ring 226 in a compressed state. In operation during locking open of the DDV 100, the retaining ring 224 moves with the sleeve 108 until abutting an inward facing shoulder 228 inside the housing 106 at which time connection between the retaining ring 224 and the sleeve 108 breaks. Continued movement of the sleeve 108 carries the C-ring 226 to an interference groove 230 around the inside of the housing 106 where the C-ring 226 expands and is trapped to lock relative movement between the housing 108 and the sleeve 106. With the sleeve 108 moved to where the C-ring 226 is located at the interference groove 230, the sleeve 108 extends through the interface between the flapper 102 and the seat 110 beyond where positioned when the DDV 100 is in an open position without being locked open.

Figure 4:
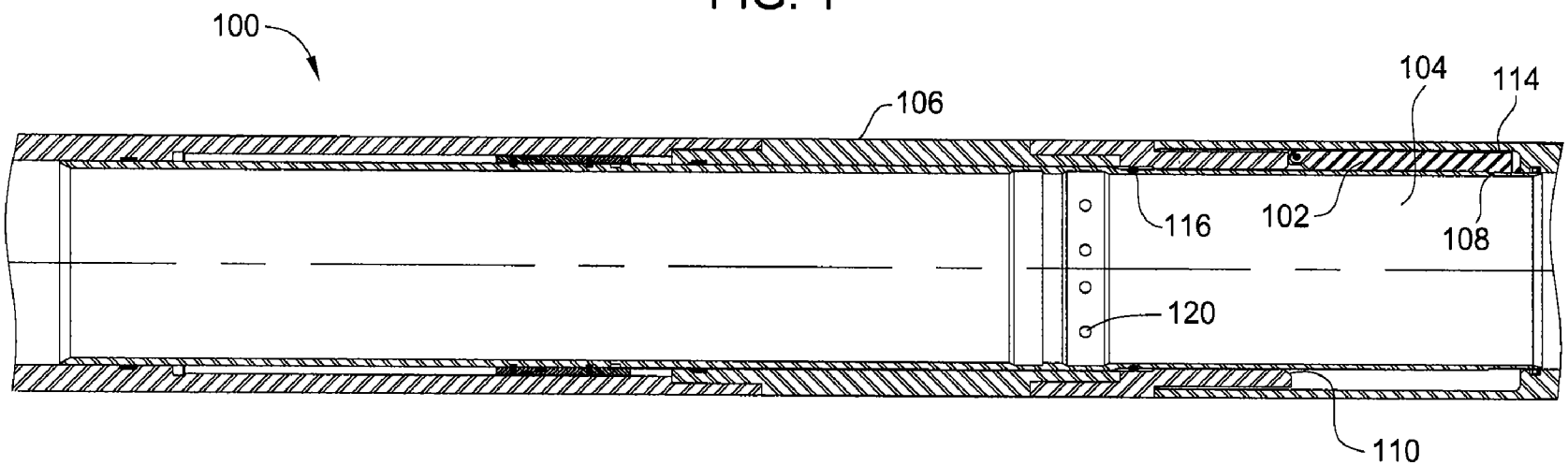
FIG. 4 is a cross section view of the DDV as shown in FIG. 1 after actuation to an open position.

FIG. 4 illustrates the DDV 100 after actuation to the open position to thereby enable tools such as a drill string to pass through the bore 104 of the DDV 100. In the open position, the sleeve 108 pushes the flapper 108 pivotally away from the seat 110 and toward a wall of the housing 106. The sleeve 108 thus physically interferes with biasing of the flapper 108 toward the seat 110. In addition, the sleeve 108 covers the flapper 102 when the DDV is in the open position to at least inhibit debris and mud from collecting around the flapper 102. Caking of mud between a backside surface of the flapper 102 and the housing 106 can cause the flapper 102 to stick in the open position after withdrawing the sleeve 108 out of interference with the flapper 102.

For some embodiments, the flapper 102 may include a secondary biasing member to facilitate initiating closure of the flapper 102 and hence mitigate effects associated with sticking open. For example, the flapper 102 may include a biasing member such as a spring metal strip 114 extending outwardly angled from the backside surface of the flapper 102 and located in some embodiments distal to a pivot point of the flapper 102. The DDV 100 in the open position pushes the spring metal strip 114 against the housing 106 causing the spring metal strip 114 to deflect. This deflection aids in kicking off return of the flapper 102 to the seat 110 after withdrawing the sleeve 108 out of interference with the flapper 102.

Figure 5:
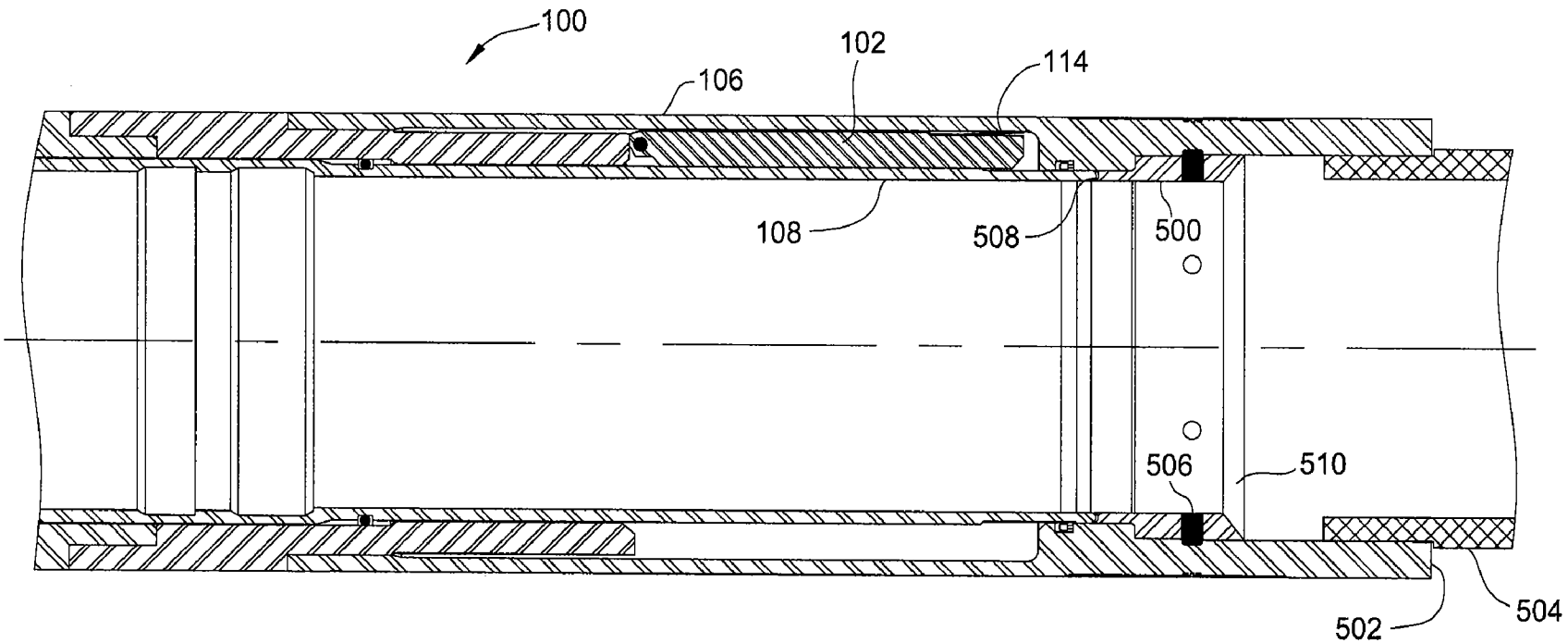
FIG. 5 is a cross section view of an actuator sleeve receptacle at a second end of the (DDV).

FIG. 5 shows an optional actuator sleeve receptacle 500 at a second end 502 of the DDV 100 where a second casing length 504 extends further into the well beyond the DDV 100. Shear pins 506 secure the receptacle 500 within the housing 106. Breaking the shear pins 506 permits longitudinal movement of the receptacle 500 to accommodate further movement of the sleeve 108 if desired to lock open the DDV 100 as described herein. The receptacle 500 includes a sleeve interface end 508, for example, any combination of a concave end, an end seal and a coated tip, corresponding to the sleeve 108 that may abut the interface end 508 when the DDV 100 is in the open position. An inward angled end 510 of the receptacle 500 opposite to the sleeve interface end 508 acts to channel flow through the DDV 100 and divert flow from going outside of the sleeve 108 to where the flapper 102 is disposed in the open position. As a result of the sleeve receptacle 500 influencing the flow, the sleeve receptacle 500 further aids in inhibiting build-up of debris around the flapper 102 leading to possible sticking open of the flapper 102.

Figure 6:
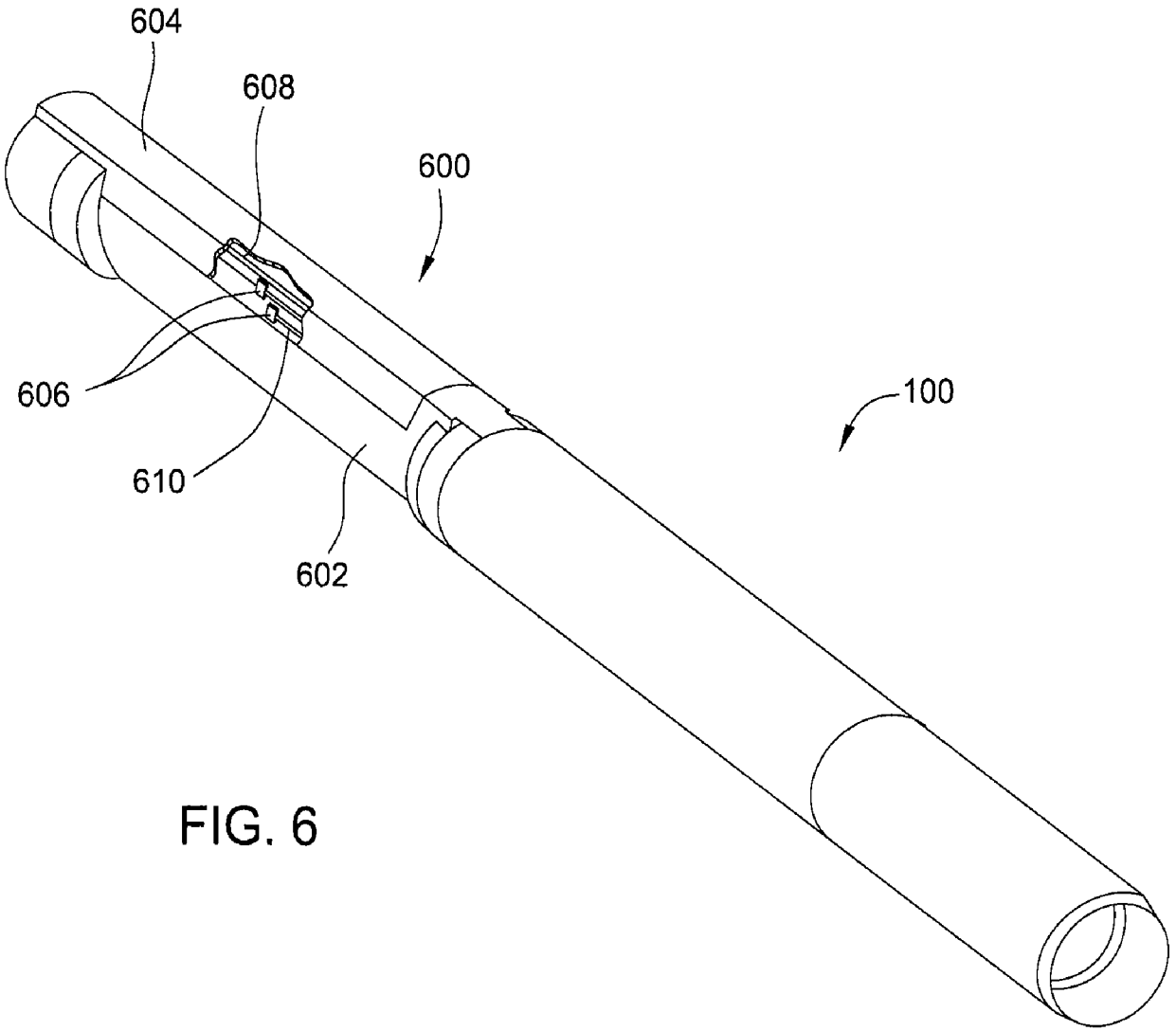
FIG. 6 is an isometric view of the DDV coupled to an instrumentation sub, according to one embodiment of the invention.

FIG. 6 illustrates an isometric view of the DDV 100 coupled to an instrumentation sub 600, which may be integral with the DDV 100 and not a separate component in some embodiments. The instrumentation sub 600 exemplifies modular component coupling with the DDV 100. The instrumentation sub 600 includes base tubing 602, a shroud 604 covering the base tubing 602, and sensors 606. The shroud 604 protects the sensors and a control line 608. For some embodiments, the sensors 606 may enable taking temperature and/or pressure measurements above and/or below the flapper 102. For example, the sensors 606 may couple via respective sensing lines to ports in pressure communication with an interior of the DDV 100 above and below the flapper 102 in a manner analogous to the connections 200 and the bores 304, 306 (shown in FIG. 3) utilized in hydraulic actuation of the sleeve 108. For some embodiments, the sensors 606 may define relay points receiving signals from pressure sensors disposed in the DDV 100 with the signals carried wirelessly or on fiber optic or electrical lines that may be run through channels also in a manner analogous to the connections 200 and the bores 304, 306.

Figure 7:
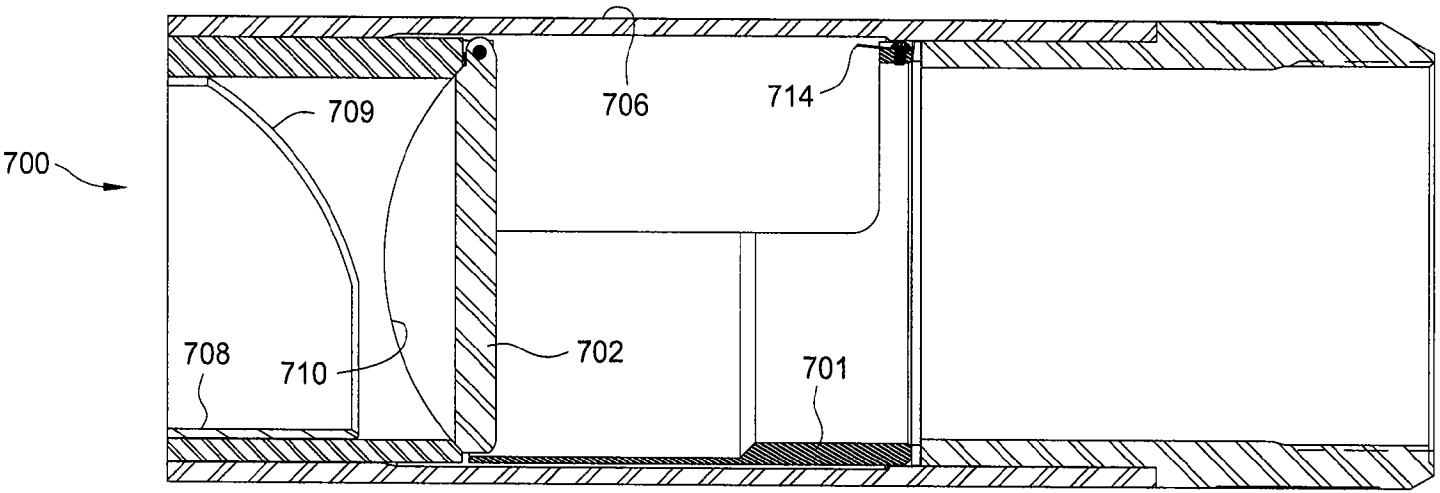
FIG. 7 is a cross section view of another DDV in a closed position, according to one embodiment of the invention.

FIG. 7 shows another DDV 700 in a closed position due to a flapper 702 being biased into contact with a seat 710. The DDV 700 includes a cage insert 701 disposed within a housing 706 of the DDV 700. Controlled longitudinal movement of a sleeve 708 functions to displace the flapper 702. The sleeve 708 includes an optional non-flat leading end 709 for contact with the flapper 702. The leading end 709 curves to protrude further toward the flapper 702 distal to a pivot point for the flapper 702. Keying of the sleeve 708 thus may maintain rotational position of the sleeve 708 relative to the flapper 702. Having the sleeve 708 initially contact the flapper 702 distal the pivot point due to the non-flat leading end 709 facilitates and improves mechanical aspects of opening the DDV 700 since a mechanical advantage is achieved by force applied further from the pivot point of the flapper 702.

Figure 8:
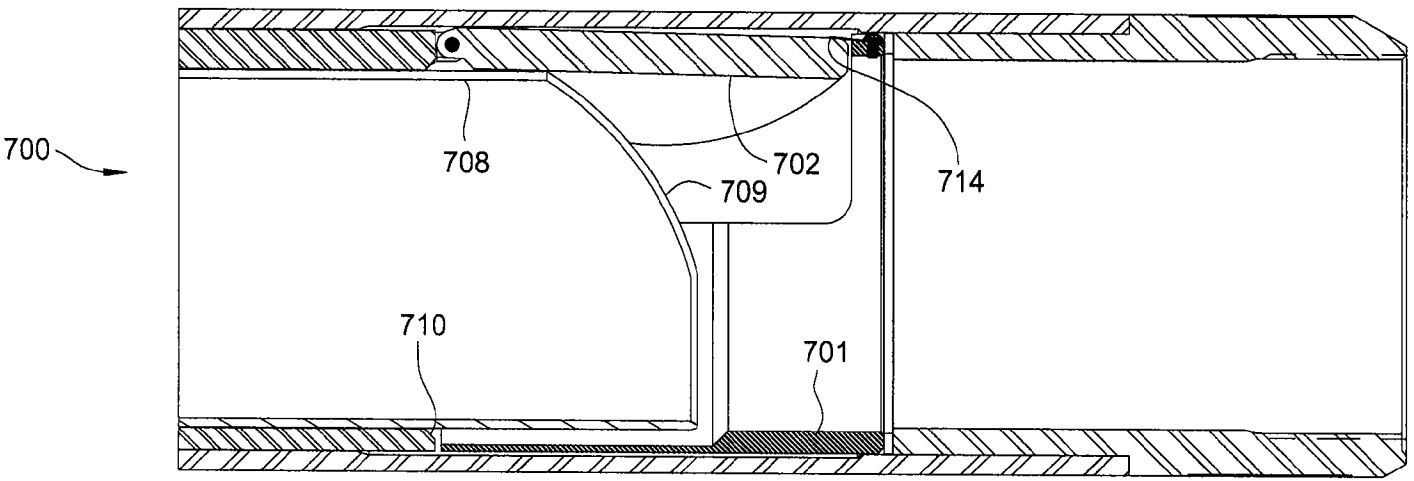
FIG. 8 is a cross section view of the DDV shown in FIG. 7 after actuation to an open position where a biasing member attached to a housing of the DDV contacts a valve member to initially facilitate closing of the valve member during return to the closed position.

FIG. 8 illustrates the DDV 700 after actuation to an open position where a biasing member shown as a spring metal strip 714 coupled to the housing 706 via the cage 701 contacts the flapper 702 to initially facilitate closing of the flapper 702 during return to the closed position. For some embodiments, other biasing members include spring washers, torsion springs, extension springs and levered springs. When the flapper 702 is displaced by the sleeve 708, the flapper 702 causes elastic bending of the spring metal strip 714 that is spaced from or bent away from an interior wall of the housing 706 in which the flapper 702 opens toward. The spring metal strip 714 then urges the flapper 702 away from the housing 706 for only a portion of pivotal travel of the flapper 702 to overcome any potential sticking with further urging provided by a primary closing force such as springs that are described herein and/or fluid pressure acting on a backside of the flapper 702.

Figure 9:
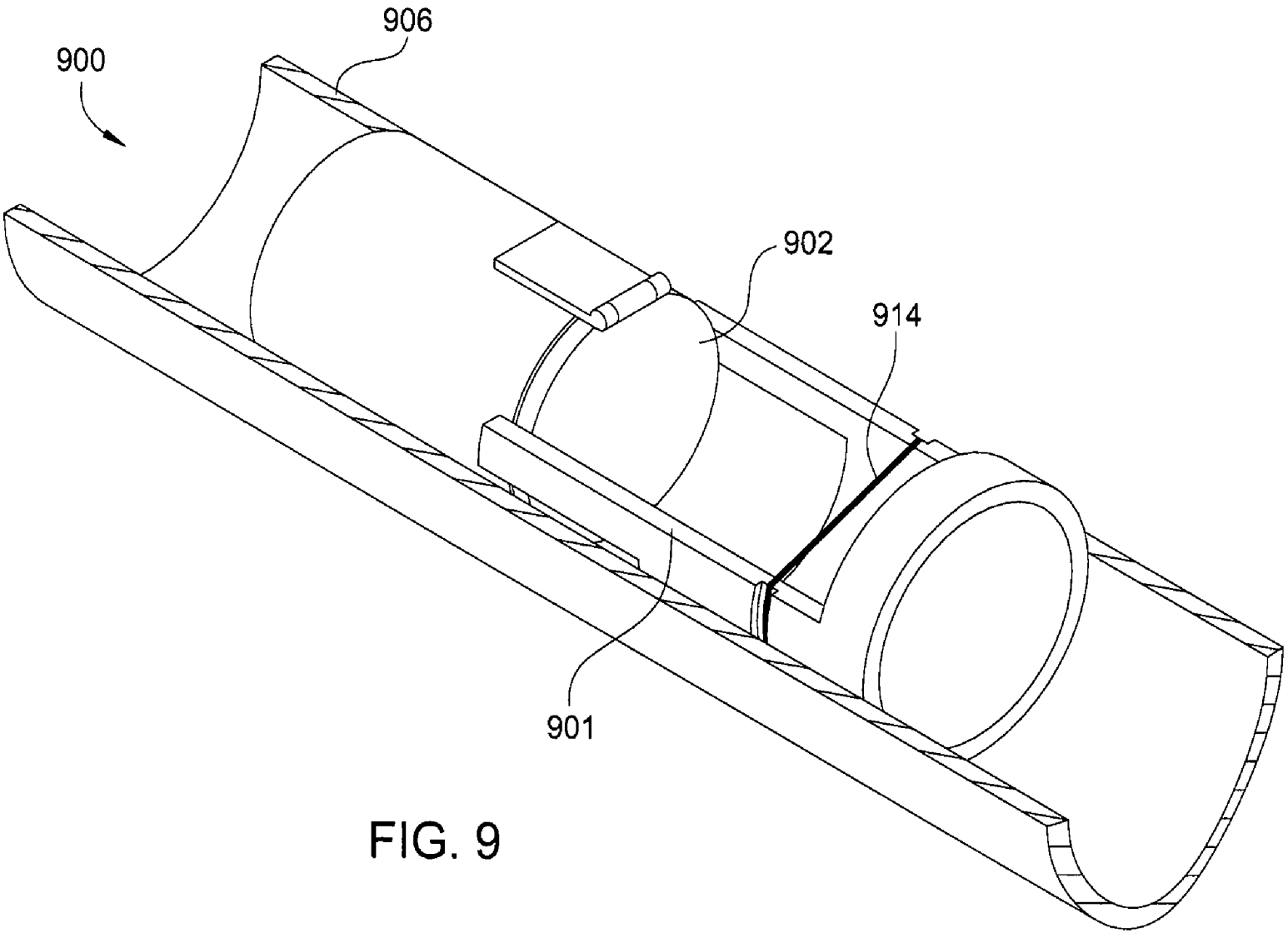
FIGS. 9 and 10 are respectively isometric and partial cross section views of an alternative biasing mechanism, according to one embodiment of the invention, for a DDV to initially facilitate closing of a valve member during return to a closed position illustrated from an open position.
Figure 10:
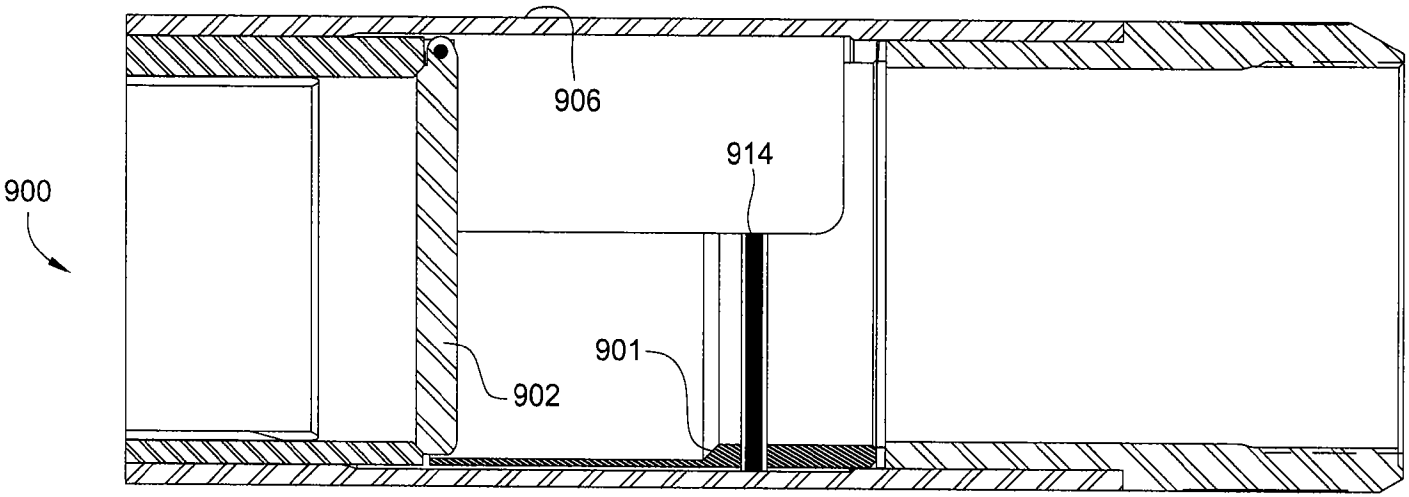

FIGS. 9 and 10 show a DDV 900 with a band 914, such as an elastomer band, disposed around a cage 901 within a housing 906 of the DDV 900 to initially facilitate closing of a flapper 902 during return from an open position to a closed position that is illustrated. An open sided tube shape of the cage 901 gives the cage 901 a partial circular cross section where the band 914 is located. The band 914 hence defines a D-shape when the DDV 900 is in the closed position due to this configuration of the cage 901. The cage 901 positions a portion of the band 914 corresponding to a flat side of the D-shape within a travel path of the flapper 902 during operation between the closed and open positions such that the flapper 902 moves or stretches the band 914 in the open position. Recovery of the band 914 ensures sufficient closing force is applied to the flapper 902 by boosting initial urging of the flapper 902 away from the housing 906 in which the flapper 902 opens toward. For some embodiments, the band 914 defines a coil spring, a scroll spring or a garter spring that enlarges in diameter due to temporary deformation upon movement of the flapper 902 to the open position.

Figure 11:
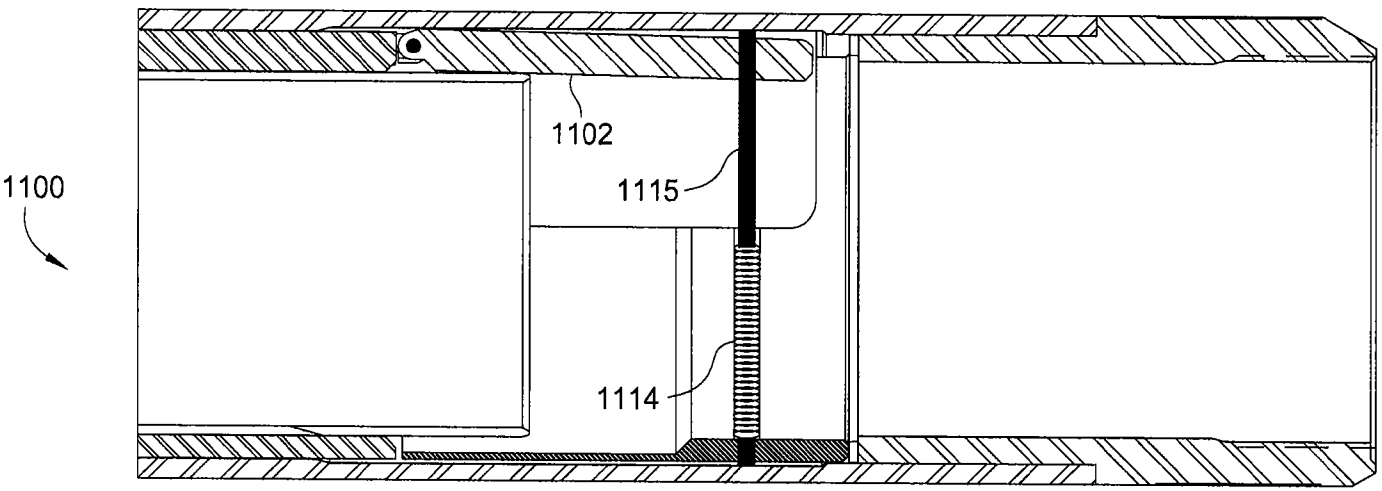
FIG. 11 is a cross section view of a DDV similar to that shown in FIGS. 9 and 10 after actuation to an open position where a band creates a pulling force on a valve member to initially facilitate closing of the valve member during return to a closed position.

FIG. 11 shows a DDV 1100 similar to that shown in FIGS. 9 and 10 after actuation to an open position. Another band having elastic or resilient properties formed with a spring section 1114 and a connecting section 1115, such as a rope, a braided or solid metal band, or a metal band strip, creates a pulling force on a flapper 1102 when in the open position. This pulling force initially facilitates closing of the flapper 1102 during return to a closed position. For illustration purposes, FIGS. 10 and 11 depict complete cross sectional views with the exception of banding used to pull the flappers 902, 1102.

Figure 24:
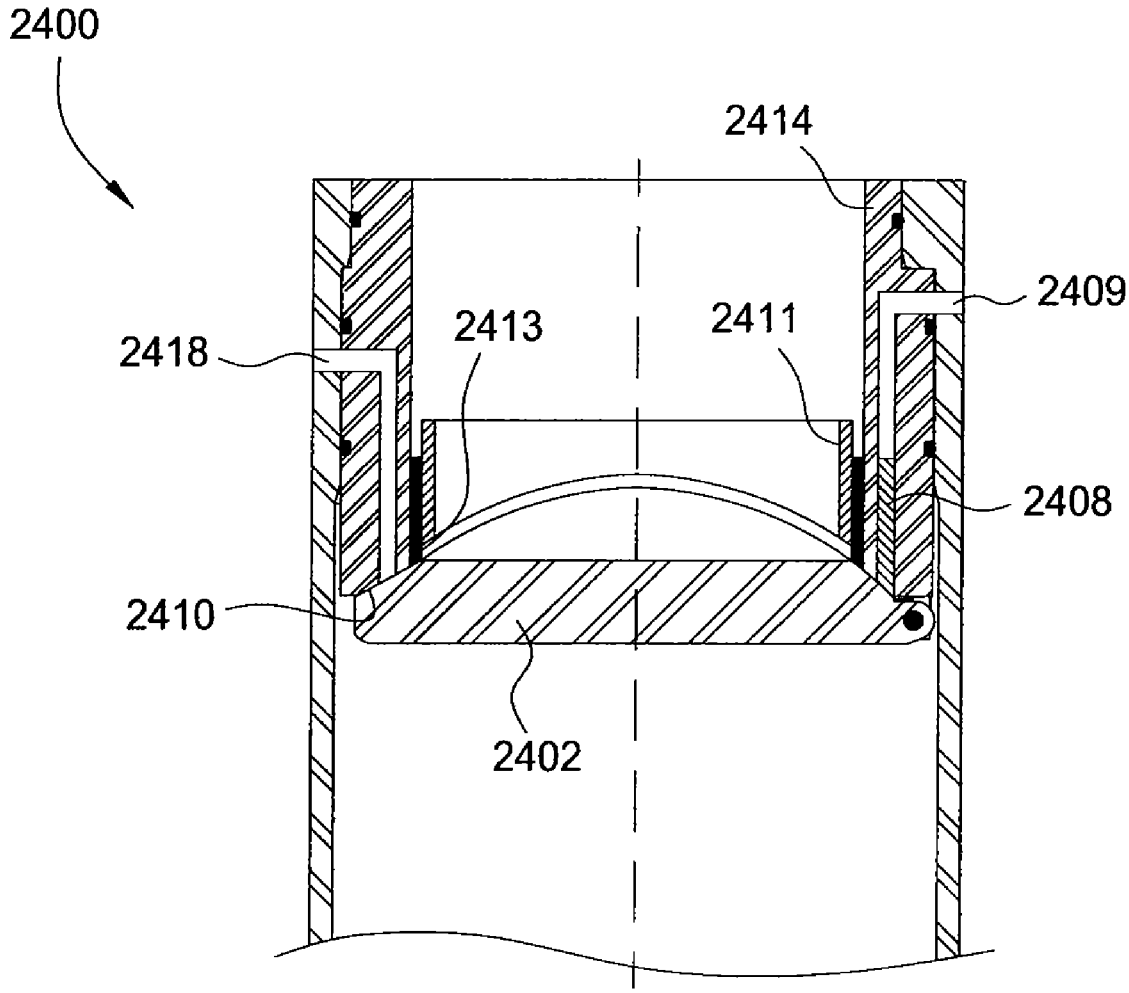
FIG. 24 is a cross section view of a DDV having a sealing element held in place by a compression ring, a rod actuating mechanism to operate the DDV from a closed position shown to an open position, and fluid passages to valve seat purging outlets, according to one embodiment of the invention.

With reference back to FIGS. 1 and 4, the DDV 100 may include a flushing feature, in some embodiments, for washing the interface between the flapper 102 and the seat 110. Debris that is composed of hard, solid particles disposed in this interface tends to hold the flapper 102 away from the seat 110 and create a leak path. Cutting of the DDV 100 at any such leak path further exacerbates the problem associated with the debris. For some embodiments, the control line connections 200 separate from ones of the connections 200 to the first and second bores 304, 306 enable flushing using control line supplied fluid such as illustrated in FIG. 24. Operation of the sleeve 108 in some embodiment acts as a syringe and plunger to push fluid past the flapper 102 during actuation from the closed position to the open position due to a wash seal 116 disposed on the sleeve 108 sealing between the sleeve 108 and the housing 106. Close tolerance between the sleeve 108 and the housing 106 at the seat 110 creates a nozzle effect facilitating the washing and removing of the debris. A fluid filled annular volume 118 between the sleeve 108 and the housing 106 along a length of the sleeve 116 that moves through the seat 110 contains fluid (e.g., drilling fluid or mud) used in the washing. The wash seal 116 moves down with the sleeve 108 during actuation to force the fluid within the annular volume 118 out around the seat 110. Ports 120 through the sleeve 108 sized to limit particulate matter may facilitate back filling of the annular volume 118 upon return to the closed position if the wash seal 116 is configured in a one-way manner. Since flushing occurs when opening, a method of operating the DDV 100 to take advantage of the flushing feature includes operating the DDV 100 through open-closed-open cycling to flush prior to final closing and isolation of pressure below the flapper 102.

Figure 12:
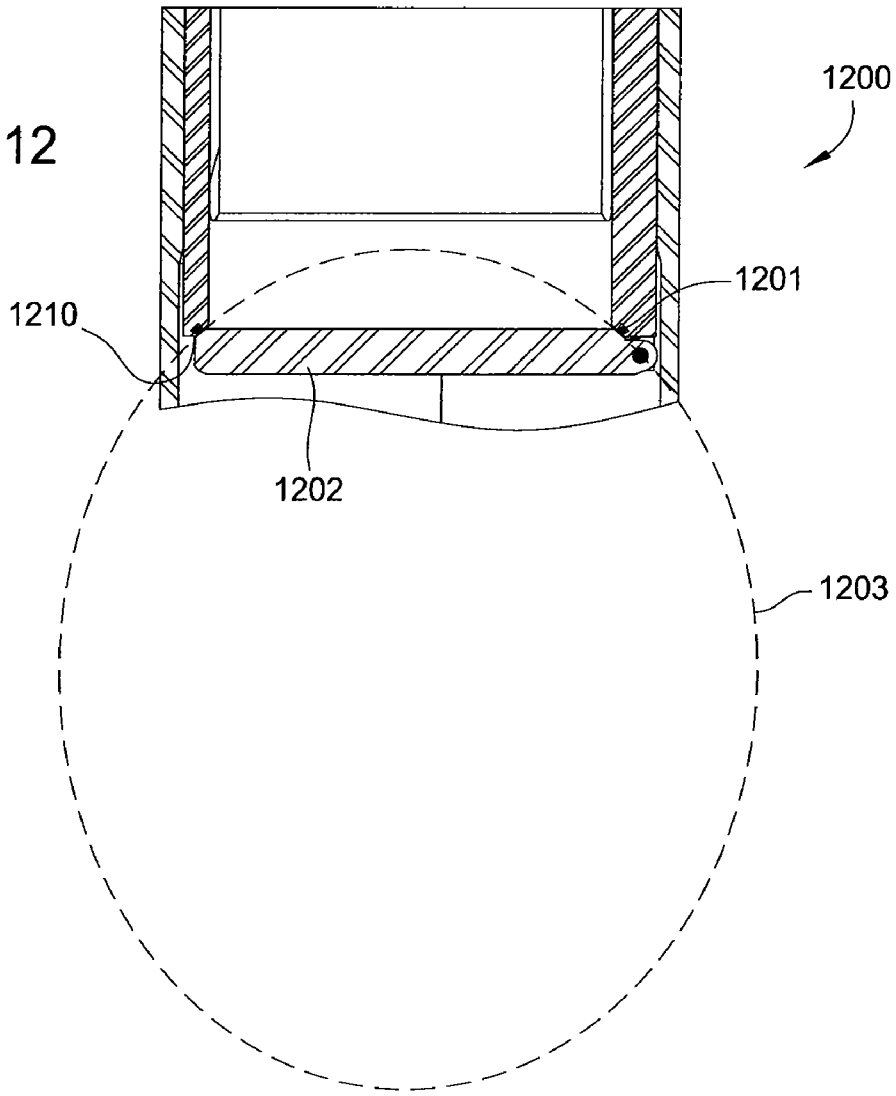
FIG. 12 is a cross section view of a DDV with a sealing element disposed at an interface between a valve member and a valve seat, according to one embodiment of the invention.
Figure 13:
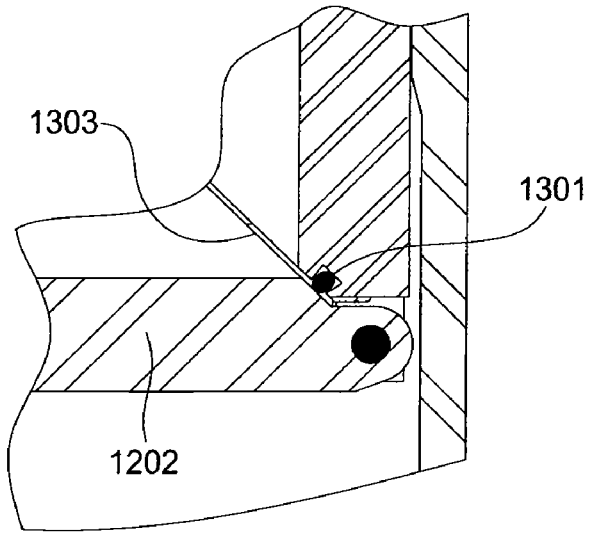
FIG. 13 is an enlarged cross section view of the interface between the valve member and the valve seat shown in FIG. 12.

FIGS. 12 and 13 illustrate a DDV 1200 with a sealing element 1201 such as an elastomeric o-ring disposed at an interface between a valve member 1202 and a valve seat 1210. For embodiments utilizing the sealing element 1201, compressibility and deformability of the sealing element 1201 helps to ensure that proper sealing occurs with the valve member 1202 even in the presence of small particles that would otherwise establish a leak path where the valve member 1202 is held off the valve seat 1210. A seal groove 1301 that may define a dovetail or other shape in the valve seat 1210 retains the sealing element 1201, which may be analogously disposed on the valve member 1202 in some embodiments.

The valve member 1202 must fit inside the DDV 1200 when the DDV is open without obstructing the bore through the DDV 1200. This requirement dictates acceptable geometry options for the valve member 1202. Unlike a cylindrical shape in prior designs where contact area varies, the valve seat 1210 defines an elliptical shape as depicted by dashed line 1203 for mating engagement with the valve member 1202 in order to make the valve seat 1210 consistent in width at locations around the perimeter of the valve seat 1210. The elliptical shape provides width of the valve seat 1210 to accommodate the seal groove 1301 at all points along the perimeter by avoiding variable narrowing of the valve seat 1210 inherent in other geometries.

As visible in FIG. 13, the valve member 1202 closes to a first stage with contact only occurring between the sealing member 1201 and the valve member 1202. This contact occurs squarely and completely around the sealing member 1201 in the first stage. A gap 1303 closes once the valve member 1202 compresses the sealing member 1201 in closing to a second stage associated with higher pressure sealing than the first stage. For some embodiments, transition between the first and second stages occurs via a biased sliding hinge member 1510 onto which the valve member 1202 pivotally secures. The sealing member 1201 initiates sealing to enhance metal to metal sealing between the valve member 1202 and the valve seat 1210 that is established in the second stage.

Figure 14:
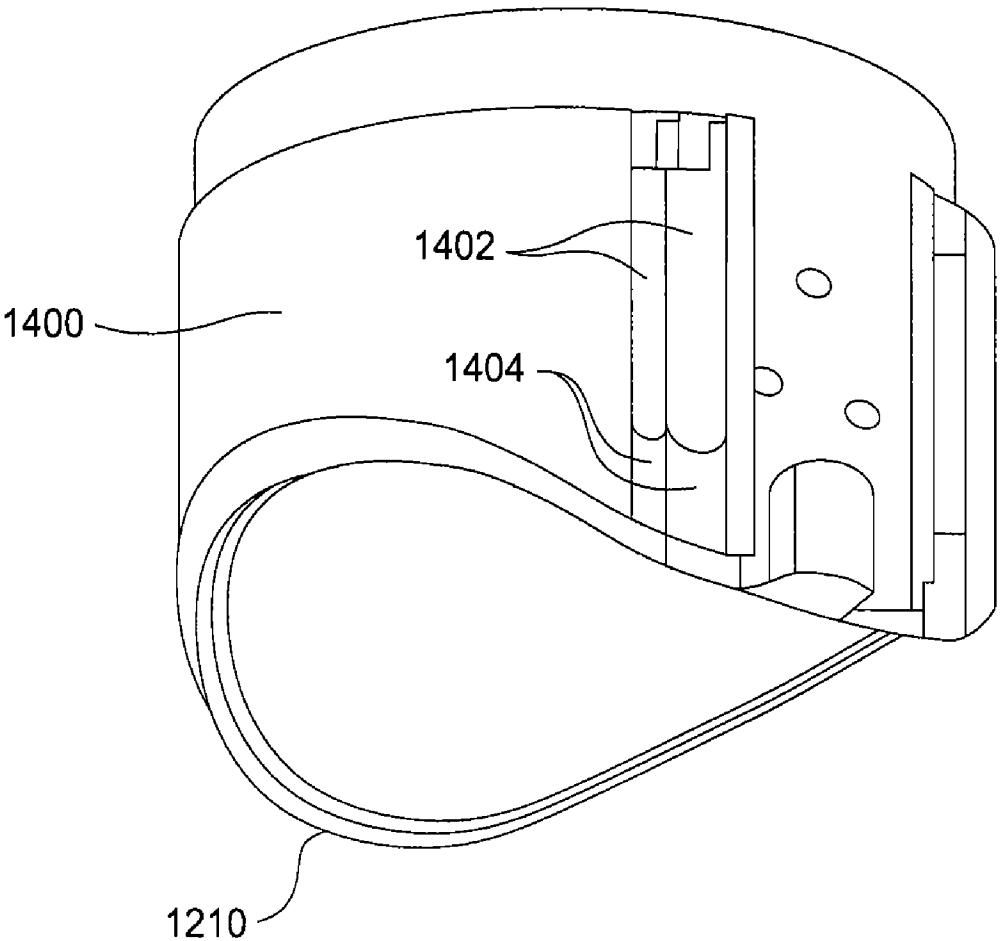
FIG. 14 is an isometric view of the valve seat member illustrated in FIG. 12.

FIG. 14 illustrates a valve seat member 1400 that provides the valve seat 1210 shown in FIG. 12. In addition to the width of the valve seat 1210 being maintained constant due to the elliptical shape, closing spring bores 1402 cutting into the outer diameter of the valve seat member 1400 may terminate for some embodiments prior to reaching an end of the valve seat member 1400 where the valve seat 1210 is defined since extension of the closing spring bores 1402 to the end of the valve seat member 1400 may reduce the width of the valve seat 1210 at corresponding locations around the valve seat 1210. In some embodiments, intermediary recesses 1404 that are relatively shallower than the closing spring bores 1402 extend from respective closing spring bores 1402 to the end of the valve seat member 1400 where the valve seat 1210 is defined.

Figure 15:
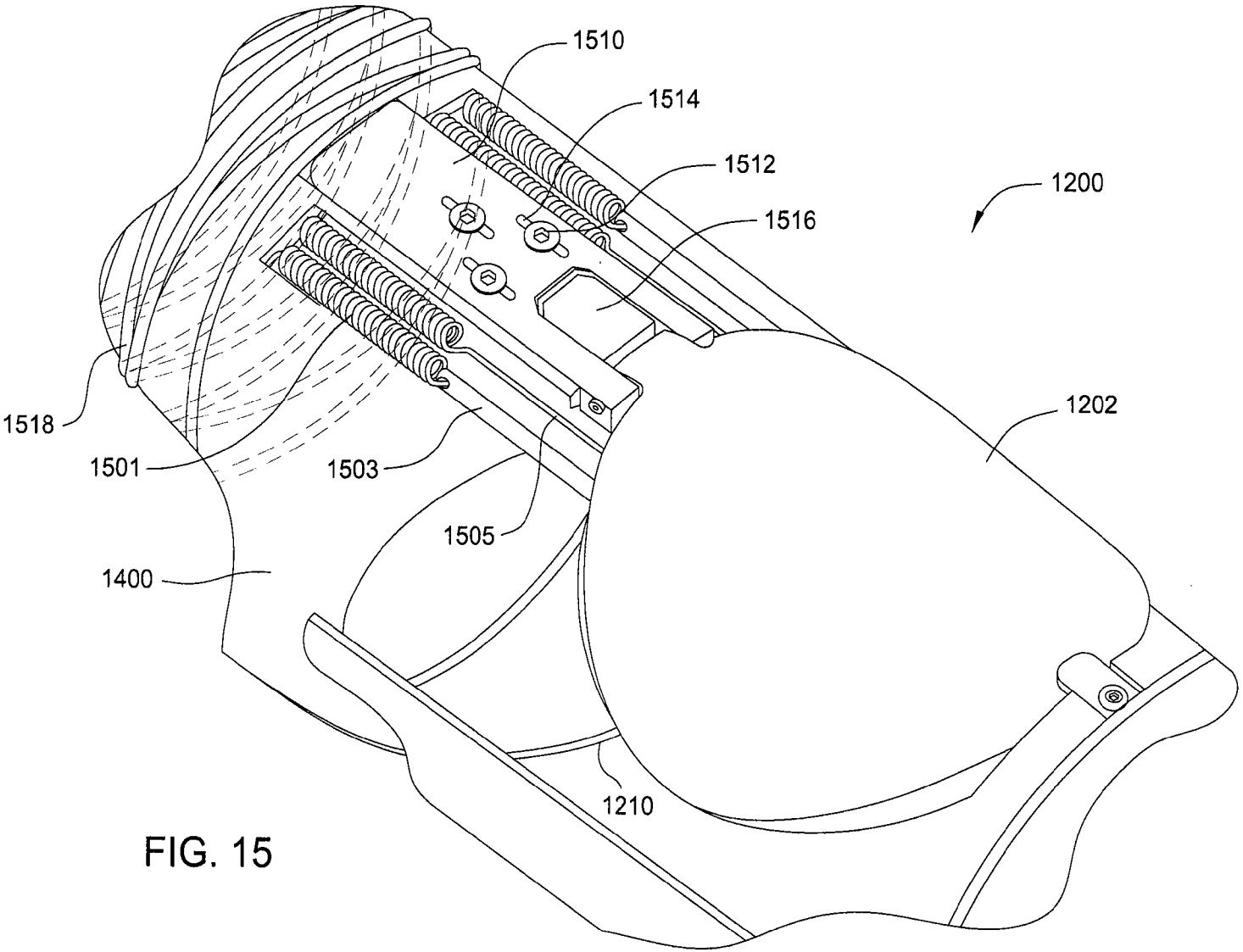
FIG. 15 is an isometric view of a DDV in an open position with closing springs coupled to a valve member by intermediary rods having a relatively smaller profile than a diameter of the springs, according to one embodiment of the invention.

FIG. 15 shows the DDV 1200 in an open position and incorporating the valve seat member 1400, which is illustrated in FIG. 14 and visible in FIG. 15 due to an outer housing of the DDV 1200 being removed for explanation purposes. Closing springs 1501 reside in respective ones of the closing spring bores 1402. The closing springs 1501 couple to the valve member 1202 by intermediary rods or plates 1503 having a relatively smaller cross sectional dimension than a diameter of the closing springs 1501. The intermediary plates 1503 may travel in respective ones of the intermediary recesses 1404 within the valve seat member 1400 during operation. For some embodiments, a straightened extension 1505 of the closing springs 1501 extends beyond the closing spring bores 1402 to couple with the valve member 1202. The closing springs 1501 pull on the valve member 1202 to urge the valve member 1202 toward the valve seat 1210 when the valve member 1202 is not held open by an actuating sleeve that is also not shown in FIG. 15 for explanation purposes.

The sliding hinge member 1510 also visible in FIG. 15 enables displacement of the pivoting point of the valve member 1202 longitudinally to permit transitioning between the first and second stages of the closed position, as described herein with reference to FIG. 13. Screws 1512 inserted through respective longitudinal slots 1514 through the hinge member 1510 and received in the valve seat member 1400 couple the hinge member 1510 to the valve seat member 1400 while permitting sliding motion of the hinge member 1510 relative to the valve seat member 1400. Length of the slots 1514 or a hinge stop 1516 interferes with movement of the hinge member 1510 in a first direction beyond a certain point, which may be associated with the closing to the first stage and accordingly displacing of the pivot point a furthest position from the valve seat 1210. A biasing member such as a hinge member spring 1518 acts on an end 1520 of the hinge member 1510 to urge the hinge member 1510 toward the hinge stop 1516. In operation, pressure on a backside of the valve member 1202 when closed to the first stage pushes the valve member 1202 and hence the hinge member 1510 against bias of the hinge member spring 1518 in order to close to the second stage. Movement of the pivot point due to the sliding hinge member 1510 maintains square mating with the valve seat 1210 in both the first and second stages.

Figure 16:
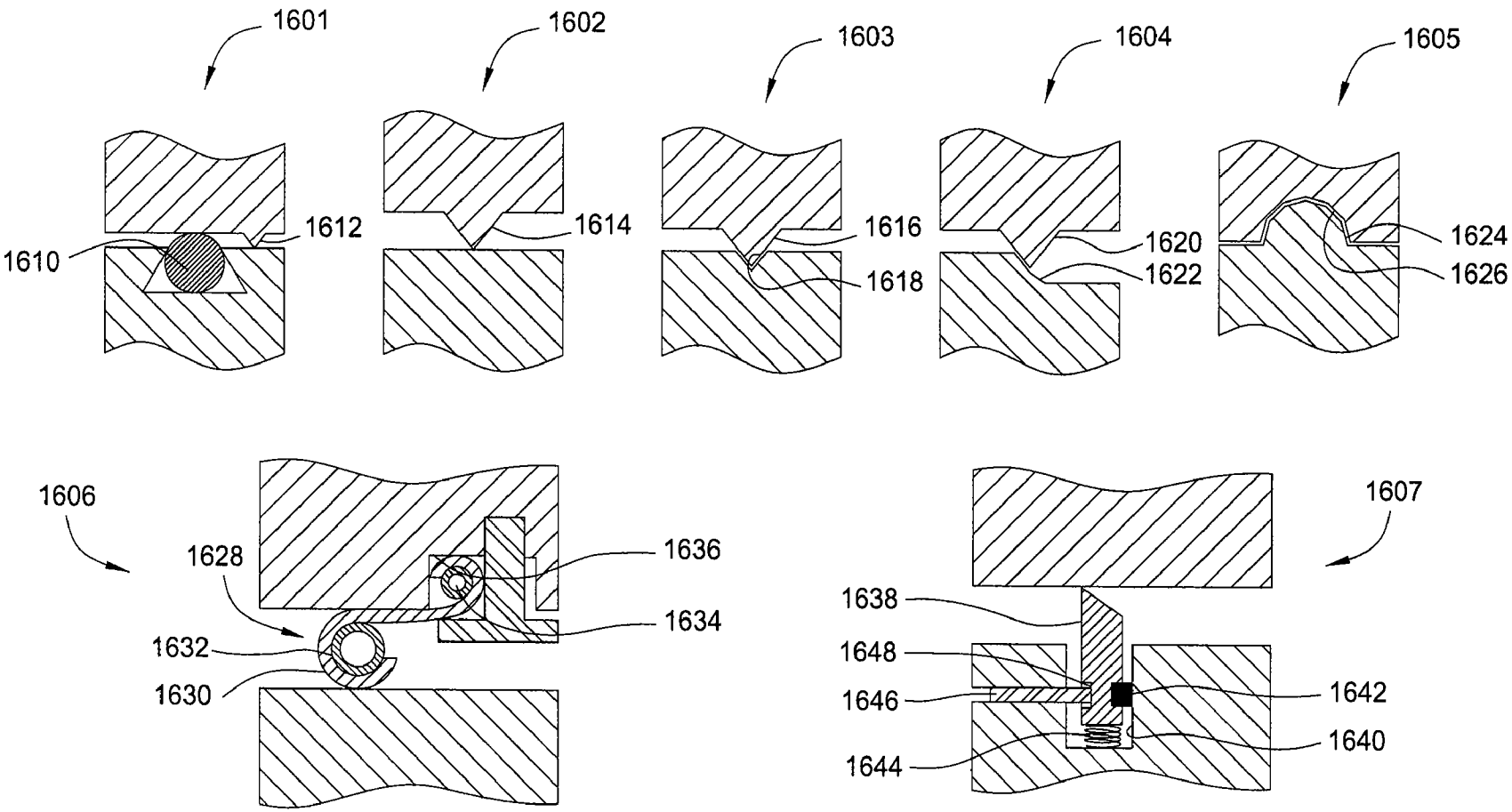
FIG. 16 is cross section views of various possible interfaces between a valve member and a valve seat for utilization with a DDV, according to one embodiment of the invention.

FIG. 16 illustrates first through seventh valve member to valve seat interfaces 1601-1607 as examples of various options to be employed in some embodiments to improve sealing which may otherwise be compromised by debris. For example, the DDV 100 shown in FIG. 1 may utilize any one of the interfaces 1601-1605 by incorporating corresponding sides of the interfaces 1601-1605 on either or both of the flapper 102 and the seat 110. The first interface 1601 includes a sealing element 1610 formed of a resilient material such as an elastomer or a metal relatively soft compared to other metals making up the interface 1601. For some embodiments, the first interface 1601 may additionally include a V-shaped feature 1612 to establish point loading around the interface 1601. The V-shaped feature 1612 tends to cut through or push aside any debris at the interface 1601.

The second interface 1602 includes a pointed protrusion 1614 alone. For some embodiments, the pointed protrusion 1614 may contact a non-metal surface such as a polymer or elastomer or a metal surface relatively soft compared to the pointed protrusion 1614. The third interface 1603 includes a preformed V-profile 1618 to mate with a V-extension 1616. The fourth interface 1604 employs progressively less steep inclines 1622 for mismatched interference engagement with angled projection 1620 such that progressive line contact occurs throughout use. The fifth interface 1605 illustrates an example of mating flats and tapers due to a stepped concave feature 1624 mating with a corresponding convex feature 1626.

The sixth interface 1606 includes a metal and plastic combination seal 1628. A plastic jacket 1630 outside and connecting first and second helical springs 1632, 1634 yields during compression and allows the combination seal 1628 to conform to surface irregularities. A trapping recess 1636 in which the second helical spring 1634 is held retains the combination seal 1628 in place at the sixth interface 1606.

The seventh interface 1607 includes an optionally pointed seat ring 1638 biased to engage an opposing surface. The seat ring 1638 slides within a trough 1640 to longitudinal positions corresponding to where seating contact occurs. A ring seal 1642 prevents passage of fluid around the seat ring 1638 within the trough 1640. While a seat ring biasing element 1644 pushes the seat ring 1638 out of the trough 1640, a pin 1646 fixed relative to the trough 1640 engages a slide limiting groove 1648 in the seat ring 1638 to retain the seat ring 1638 in the trough 1640.

Figure 17A:
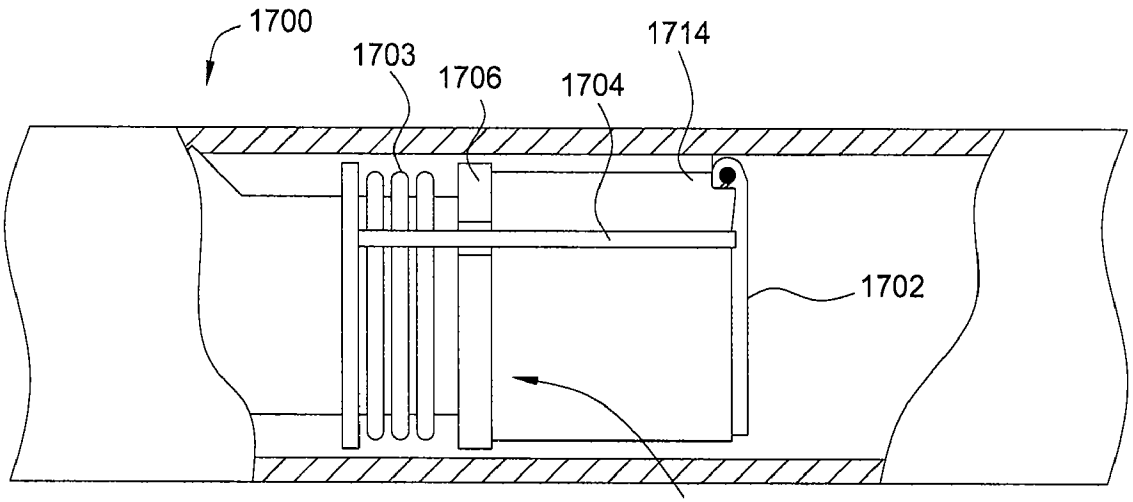
FIGS. 17A and 17B are partial cross section views of respectively a DDV in a closed position and a DDV in a partial open position, which function by a biased closure mechanism operating under compression, according to embodiments of the invention.

FIG. 17A shows a DDV 1700 in a closed position as maintained by a biased closure mechanism 1701 operating under compression. In contrast to the closing springs 1501 shown in FIG. 15 that operate in tension, a biasing member such as a coil spring 1703 disposed around a valve seat body 1714 functions under compression to pivotally urge a flapper 1702 against the valve seat body 1714 and hence close the DDV 1700. Similar to the intermediary plates 1503 shown in FIG. 15, a linkage arm 1704 couples the flapper 1702 with the coil spring 1703 and traverses the interface between the valve seat body 1714 and the flapper 1702 without reducing surface area sealing contact of the flapper 1702. Altering longitudinal position of a base 1705 for the coil spring 1703 enables adjusting amount of compression in the coil spring 1703. For some embodiments, a cable forms the linkage arm 1704 that may be disposed beyond a midpoint of the flapper 1702 toward a distal end of the flapper relative to a pivot point of the flapper 1702. As the distance from the pivot point increases, the moment increases that is applied by the spring 1703 so that the flapper 1702 may more securely shut from just the force of the spring 1703.

Figure 17B:
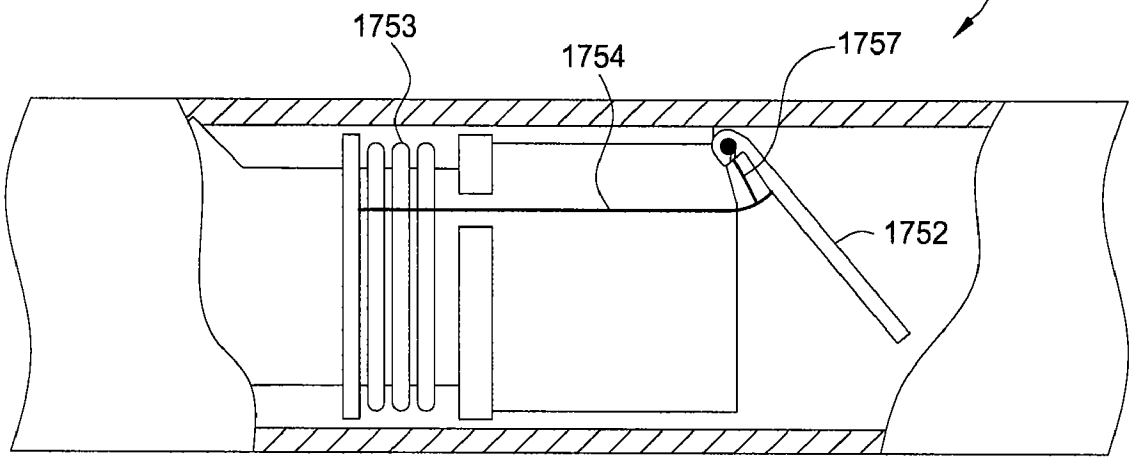

FIG. 17B shows a DDV 1751 in a partial open position and similar to the DDV 1700 shown in FIG. 17A such that most like parts are not labeled or further described. A linkage cable 1754 couples a flapper 1752 with a coil spring 1753. A cable guide or cam 1757 aligns or supports the cable 1754 and may be moveable with movement of the flapper 1752.

Figure 18:
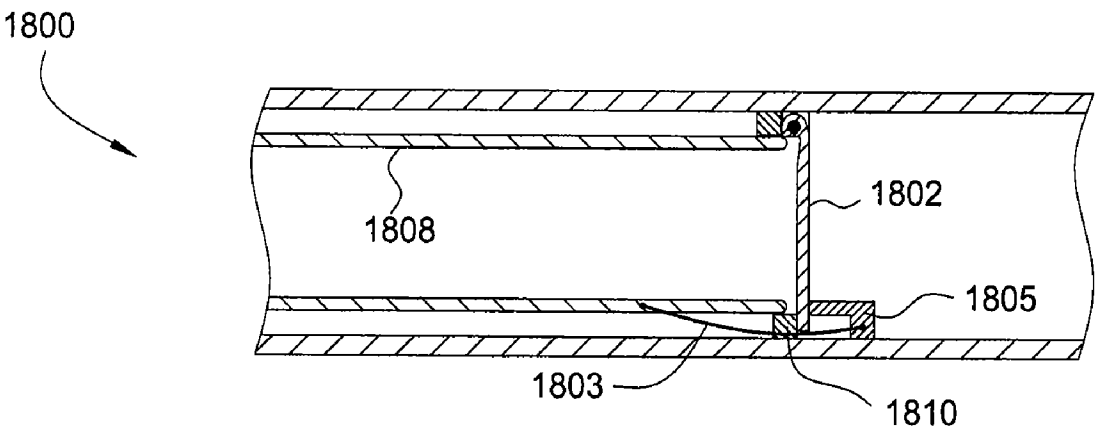
FIG. 18 is a cross section view of a DDV secured in a closed position by an engaging mechanism that is coupled to an actuating sleeve of the DDV and in contact with a backside of a valve member in the closed position, according to one embodiment of the invention.

FIG. 18 illustrates a DDV 1800 secured in a closed position by a chock 1805 coupled to an actuating sleeve 1808 of the DDV 1800 by a tether 1803. A first end of the tether 1803 secures to the sleeve 1808. The tether 1803 then passes across a valve seat 1810 so that a second end of the tether 1803 affixes to the chock 1805. Tension in the tether 1803 due to location of the sleeve 1808 while the DDV 1800 is in the closed position disposes the chock 1805 against a backside of the flapper 1802. Actuation of the sleeve 1808 augments biasing of the flapper 1802 to push the flapper against the seat at final closing of the flapper 1802 and locks the flapper 1802 in position while the DDV 1800 is closed. Forces acting on the flapper 1802 that overcome the bias of the flapper 1802 fail to open the flapper 1802 unless the sleeve is moved to release the chock 1805.

Figure 19:
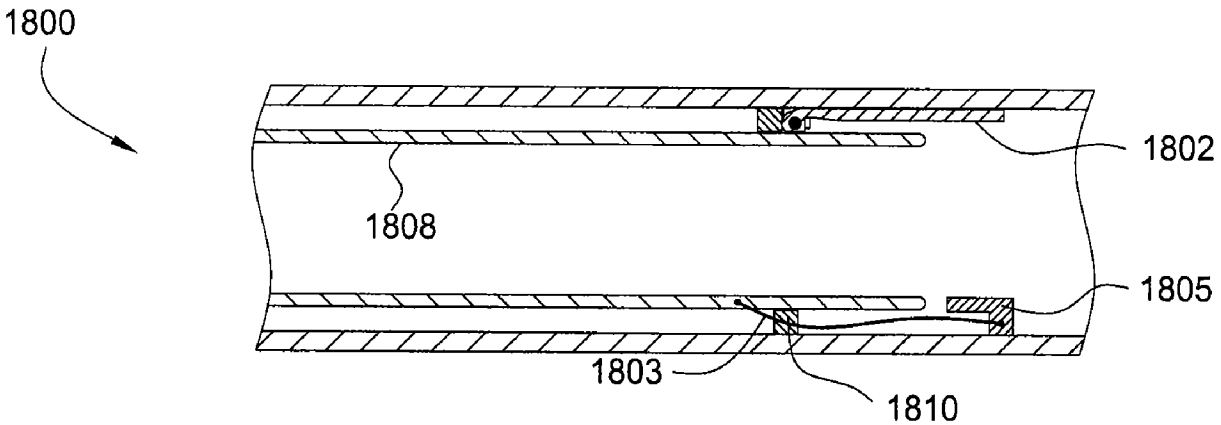
FIG. 19 is a cross section view of the DDV as shown in FIG. 18 after actuation to an open position.

FIG. 19 shows a cross section view of the DDV 1800 after actuation to an open position. Movement of the sleeve 1808 toward the flapper 1802 releases tension in the tether 1803 and allows the chock 1805 to clear from interference with pivoting motion of the flapper 1802. Subsequent contact of the sleeve 1808 with the flapper 1802 in the open position then displaces the flapper 1802 from the seat 1810 against closing bias of the flapper 1802.

Figure 20:
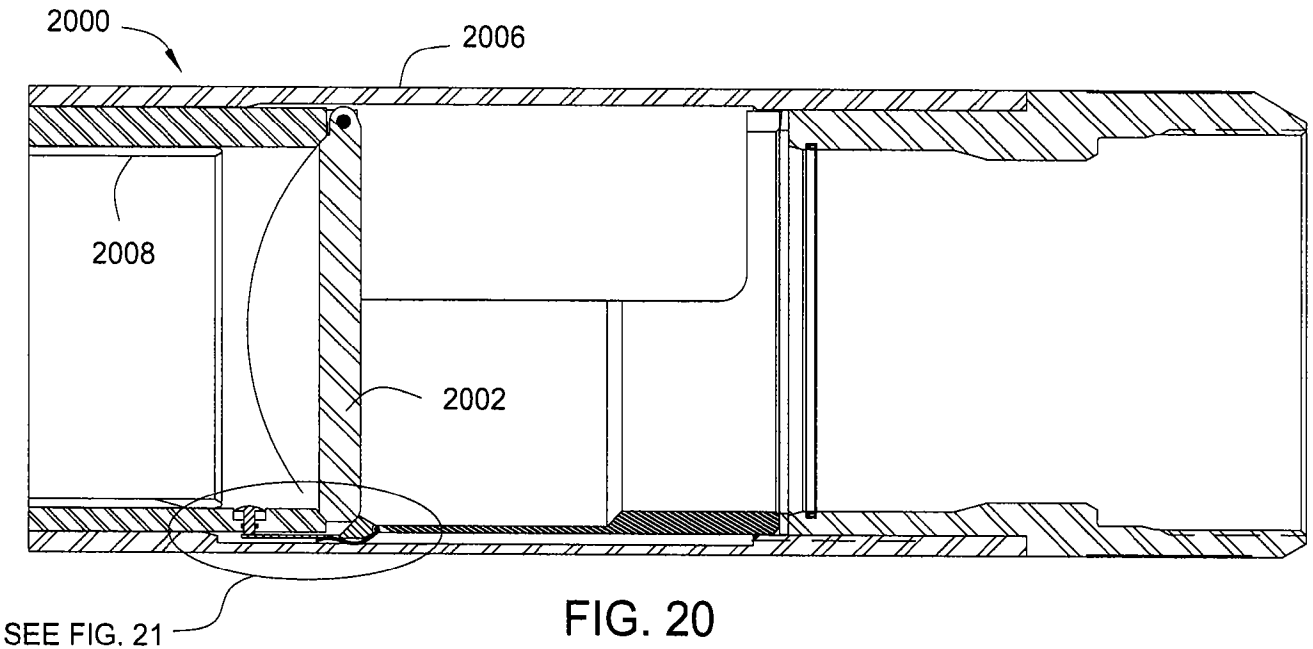
FIG. 20 is a cross section view of a DDV secured in a closed position by another engaging mechanism that is deactivated by an actuating sleeve of the DDV and in contact with a backside of a valve member in the closed position, according to one embodiment of the invention.
Figure 21:
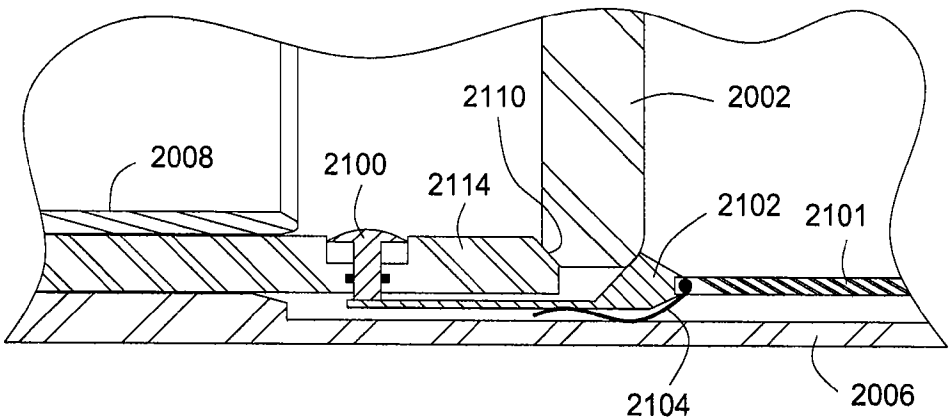
FIG. 21 is an enlarged cross section view of the engaging mechanism shown in FIG. 20.

FIGS. 20 and 21 illustrate a DDV 2000 secured in a closed position by a blocking lever 2102 that is disengaged by sliding movement of an actuating sleeve 2008 of the DDV 2000. In the closed position, a portion of the lever 2102 contacts a backside of a valve member 2002 to positively latch the valve member 2002 secured against a valve seat 2110 without reliance on biasing of the valve member 2002 to maintain sealing contact between the valve seat 2110 and the valve member 2002. A biasing element 2104 forces the lever 2102 away from a housing 2006 of the DDV 2000 when the sleeve 2008 is actuated to a position retracted away from interference with the valve member 2002. Prior to contacting the valve member 2002 during movement of the sleeve 2008 to displace the valve member 2002, movement of the sleeve 2008 toward the valve member 2002 disengages the lever 2102 from interference with pivoting motion of the valve member 2002.

The lever 2102 pivotally couples to a cage insert 2101 in the housing 2006 through which the valve member 2002 opens. The lever 2102 extends beyond the valve seat 2110 to a button 2100 that passes through an aperture in a wall of a valve seat body 2114. Sealed sliding movement of the button 2100 relative to the valve seat body 2114 translates pivotal motion to the lever 2102 that is biased by the biasing element 2104 in a manner that urges the button 2100 in a radial inward direction to an activated position. The button 2100 extends in the activated position within a path of the sleeve 2008 during movement of the sleeve 2008 to open the DDV 2000. In operation to open the DDV 2000, the sleeve 2008 contacts the button 2100 forcing the button 2100 in a radial outward direction and to a deactivated position out of the path of the sleeve 2008. This movement of the button 2100 moves the lever 2102 closer to the housing 2006 against bias of the biasing element 2104 and hence away from contact with the valve member 2002. Continued movement of the sleeve 2008 then displaces the valve member 2002 that is no longer secured or locked in position by the lever 2102.

Figure 22:
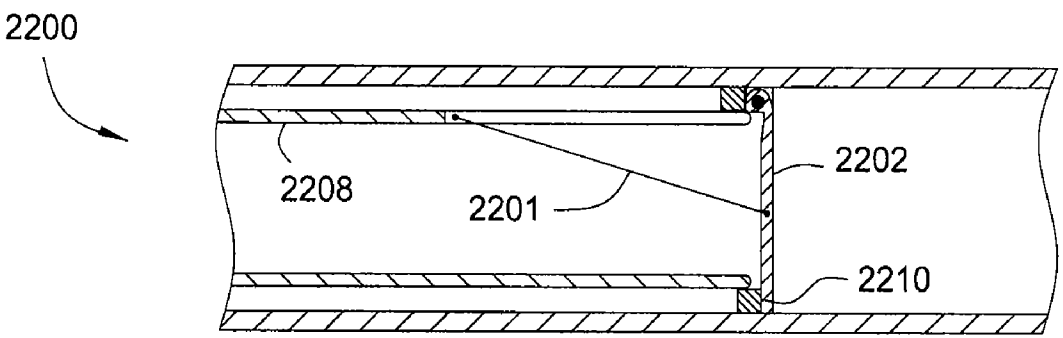
FIG. 22 is a cross section view of a DDV positively actuated to a closed position by a linkage mechanism coupling an actuating sleeve of the DDV to a valve member, according to one embodiment of the invention.

FIG. 22 illustrates a cross section view of a DDV 2200 positively actuated to a closed position by a linkage 2201 coupling an actuating sleeve 2208 of the DDV 2200 to a valve member 2202. The linkage 2201 may include a cable, wire, chain and/or rigid rods having ends affixed respectively to the sleeve 2208 and the valve member 2202. As discussed herein, affixing the linkage 2201 farther from a pivot point of the valve member 2202 produces a larger moment about the pivot point than the same force positioned closer to the pivot point. The linkage 2201 enables mechanically pushing/pulling the valve member 2202 to a desired position. For some embodiments, actuation of the sleeve 2208 augments biasing of the valve member 2202 to pull the valve member 2202 against a seat 2210. Active actuation to close the DDV 2200 by controlled amount of force that may be maintained on the valve member 2202 to hold the valve member 2202 against the seat 2210 occurs based on tension supplied to the linkage 2201 by actuation of the sleeve 2208.

Figure 23:
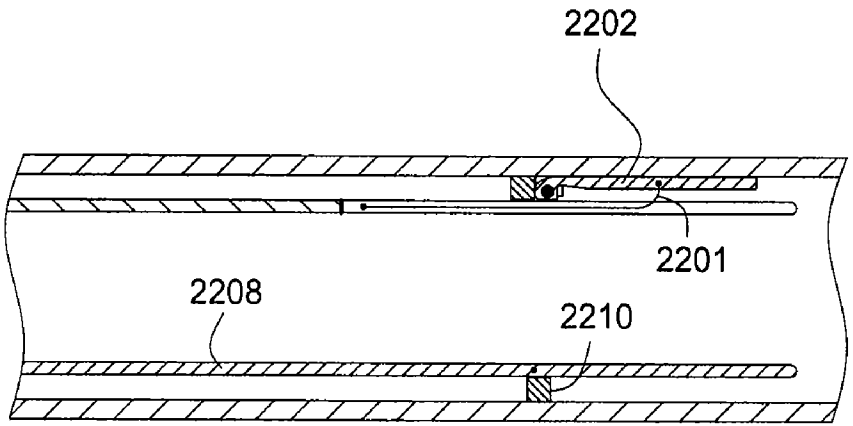
FIG. 23 is a cross section view of the DDV as shown in FIG. 22 after actuation to an open position.

FIG. 23 shows a cross section view of the DDV 2200 after actuation to the open position. In operation, the sleeve 2208 moves through the valve seat 2210 to displace the valve member 2202. As the sleeve 2208 moves, the linkage 2201 travels with the sleeve 2208 releasing tension in the linkage 2201 and enabling pivoting of the valve member 2202.

FIG. 24 illustrates a DDV 2400 having a flapper 2402 biased into sealing engagement against a valve seat 2410. The DDV 2400 further includes a sealing element such as a polytetrafluoroethylene tubular insert 2413 held in place within a valve seat body 2414 by a compression ring 2411 that sandwiches the insert 2413 against an inner diameter of the valve seat body 2414 at the valve seat 2410 such that the flapper 2402 contacts the insert 2413. For some embodiments, first fluid porting 2418 provides washing fluid through seat purge passages discharging along or adjacent the valve seat 2410 for washing any debris from an interface between the valve seat 2410 and the flapper 2402. Second fluid porting 2409 introduces pressurized fluid to a rod actuator 2408 in some embodiments. The first fluid porting 2418 and the second fluid porting 2409 may each connect to surface through a control line coupled to the DDV 2400.

One end of the rod actuator 2408 contacts some flapper assembly surface, such as the flapper 2402, offset from a pivot point of the flapper 2402, such as between the pivot point and the valve seat 2410. In operation, the rod actuator 2408 slides longitudinally in response to the pressurized fluid to operate the DDV 2400 from a closed position shown to an open position. In some embodiments, a portion of the second fluid porting 2409 defines a bore in the valve seat member 2414 in which the rod actuator 2408 is disposed. Bias of the flapper 2402 returns the rod actuator 2408 to a retracted position within the second fluid porting 2409 upon closure of the flapper 2402 in absence of pressurized fluid supplied to the second fluid porting 2409.

For illustration purposes and succinctness without showing all permutations, designs discussed heretofore include various aspects or features which may be combined with or implemented separately from one another in different arrangements, for some embodiments. These aspects that work in combination include any that do not interfere with one another as evident by the foregoing. For example, any DDV may benefit from one of the seat seals as discussed herein, may incorporate secondary biasing mechanisms to facilitate initiating valve member closure, may include valve seat jet washing ability, and/or provide positive lock closed positions. Such independent variations in contemplated embodiments may depend on particular applications in which the DDV is implemented.

While the foregoing is directed to embodiments of the present invention, other and further embodiments of the invention may be devised without departing from the basic scope thereof, and the scope thereof is determined by the claims that follow.

What is claimed is:

1. A downhole deployment valve (DDV) for disposal in a casing string in a borehole, comprising:

a housing having a first coupling end to couple with a tubing section end that integrates with the DDV to form the casing string;

a valve member moveable between a first position obstructing a bore through the housing and a second position permitting tool passage through the bore;

a first biasing member coupled to the valve member to urge the valve member from the second position to the first position;

a second biasing member attached to a cage disposed within the housing, the second biasing member being configured to engage with the valve member in the second position to urge the valve member initially away from the second position toward the first position; and an actuator sleeve having a first leading edge portion and a second leading edge portion, wherein the first leading edge portion contacts the valve member before the second leading edge portion when the sleeve displaces the valve member to the second position and the first leading edge portion contacts the valve member at a point that is further from a pivot point of the valve member than the second leading edge portion, and wherein the first and second leading edge portions are separated by convex edge portions.

2. The DDV of claim 1, wherein the second biasing member comprises a spring metal strip coupled to at least one of the valve member and the housing and positioned such that the second position of the valve member flexes the strip.

3. The DDV of claim 1, wherein the first biasing member comprises a spring in compression.

4. The DDV of claim 1, wherein the first leading edge portion is a substantially straight edge portion and the second leading edge portion is a substantially straight edge portion.

5. The DDV of claim 1, wherein a length of the actuator sleeve at the first leading edge portion is longer than a length of the actuator sleeve at the second leading edge portion.

6. A downhole deployment valve (DDV) comprising:

a housing having a first coupling end to couple with a tubing section end;

a valve member moveable between a first position obstructing a bore through the housing and a second position permitting tool passage through the bore;

a first biasing member coupled to the valve member to urge the valve member from the second position to the first position;

a second biasing member engaged with the valve member in the second position to urge the valve member initially away from the second position toward the first position; and a cage disposed in the housing, wherein the second biasing member is connected to the cage.

7. The DDV of claim 6, wherein the second biasing member comprises a spring metal strip coupled to the housing via the cage and positioned such that the second position of the valve member flexes the strip.

8. The DDV of claim 6, further comprising:

an actuator sleeve movable within the housing between a retracted location spaced from the valve member and an extended location passing through a valve seat to displace the valve member to the second position; and a sleeve receptacle disposed in the housing, wherein the receptacle has a first end mated with the sleeve in the extended location and a second end defining an edge angled inward.

9. The DDV of claim 6, wherein the first biasing member comprises a spring in compression.

10. The DDV of claim 9, wherein the spring is coupled to the valve member via a linkage arm.

11. The DDV of claim 6, wherein the second biasing member is supported at one end by the cage.

12. The DDV of claim 6, wherein the second biasing member extends from an edge of the cage.

13. The DDV of claim 6, wherein the first biasing member is comprises a spring in tension.

14. The DDV of claim 13, wherein the spring is configured to apply a pulling force on the valve member to urge the valve member from the second position to the first position.

15. The DDV of claim 6, further comprising an actuator sleeve configured to move the valve member from the first position to the second position.

16. The DDV of claim 15, wherein the actuator sleeve includes a first leading edge portion and a second leading edge portion.

17. The DDV of claim 16, wherein the first leading edge portion contacts the valve member before the second leading edge portion when the sleeve displaces the valve member to the second position.

18. The DDV of claim 16, wherein the first leading edge portion contacts the valve member at a point that is further from a pivot point of the valve member than the second leading edge portion.

19. The DDV of claim 16, wherein the first leading edge portion is a substantially straight edge portion and the second leading edge portion is a substantially straight edge portion.

20. A downhole deployment valve (DDV) for disposal in a casing string in a borehole, comprising:

a housing having a first coupling end to couple with a tubing section end that integrates with the DDV to form the casing string;

a valve member moveable between a first position obstructing a bore through the housing and a second position permitting tool passage through the bore;

a first biasing member coupled to the valve member to urge the valve member from the second position to the first position;

a second biasing member engaged with the valve member in the second position to urge the valve member initially away from the second position toward the first position;

an actuator sleeve movable within the housing between a retracted location spaced from the valve member and an extended location passing through a valve seat to displace the valve member to the second position; and a sleeve receptacle disposed in the housing, wherein the receptacle has a first end that mates with the sleeve in the extended location and a second end defining an edge angled inward.

21. The DDV of claim 20, wherein the edge angled inward is configured to channel flow through the DDV when the sleeve is in the extended location.

* * * * *